US008985404B2

(12) United States Patent
Moezidis et al.

(10) Patent No.: US 8,985,404 B2
(45) Date of Patent: Mar. 24, 2015

(54) LIQUID DISPENSING HEAD FORCIBLY DETACHABLE FROM BOTTLE OR CONTAINER

(76) Inventors: Nick Moezidis, San Jose, CA (US); Morris Taradalsky, San Jose, CA (US); Ross Rittiman, San Jose, CA (US); Jeffrey Brooks, San Jose, CA (US); Edward A. Vetter, Santa Clara, CA (US)

( * ) Notice: Subject to any disclaimer, the term of this patent is extended or adjusted under 35 U.S.C. 154(b) by 140 days.

(21) Appl. No.: 13/598,482

(22) Filed: Aug. 29, 2012

(65) Prior Publication Data

US 2013/0240572 A1 Sep. 19, 2013

Related U.S. Application Data

(60) Provisional application No. 61/528,549, filed on Aug. 29, 2011.

(51) Int. Cl.

| | |
|---|---|
| ***B65D 83/00*** | (2006.01) |
| ***B67D 1/08*** | (2006.01) |
| ***B65D 41/04*** | (2006.01) |
| ***B67D 7/72*** | (2010.01) |
| ***B67D 1/04*** | (2006.01) |
| ***B67D 1/07*** | (2006.01) |
| *B67D 1/00* | (2006.01) |

(52) U.S. Cl.

CPC ..... *B67D 1/0841* (2013.01); *B65D 41/0442* (2013.01); *B67D 7/72* (2013.01); *B67D 1/0412* (2013.01); *B67D 1/07* (2013.01); *B67D 2001/0098* (2013.01); *B67D 2001/0481* (2013.01)

USPC ..... 222/400.7; 222/567; 222/569; 215/295

(58) Field of Classification Search

CPC ..... B67B 1/00; B65D 39/00; B65D 39/0052; B65D 39/0058; B65D 39/0076; B65D 39/16; B67D 1/0006; B67D 1/0412

USPC ..... 222/400.7, 567, 569; 220/287, 304; 215/228, 295, 296, 355, 364

See application file for complete search history.

(56) References Cited

U.S. PATENT DOCUMENTS

| | | | | |
|---|---|---|---|---|
| 650,615 | A * | 5/1900 | Salomon | 215/307 |
| 650,617 | A * | 5/1900 | Salomon | 222/192 |
| 2,646,293 | A * | 7/1953 | Gray | 222/400.7 |
| 2,703,670 | A * | 3/1955 | Voight | 141/340 |
| 2,801,017 | A * | 7/1957 | Cortat | 215/296 |
| 4,391,779 | A * | 7/1983 | Miskinis | 422/568 |
| 4,702,396 | A * | 10/1987 | Gwiazda | 222/152 |
| 4,850,387 | A * | 7/1989 | Bassill | 137/212 |
| 5,109,997 | A * | 5/1992 | Phillips | 215/360 |
| 5,667,110 | A * | 9/1997 | McCann et al. | 222/386.5 |
| 7,490,629 | B2 * | 2/2009 | Williams et al. | 138/89 |
| 7,712,631 | B2 | 5/2010 | Taradalsky et al. | |
| 2010/0018972 | A1 * | 1/2010 | Kao | 220/212 |
| 2011/0204093 | A1 * | 8/2011 | Lee | 222/152 |

* cited by examiner

*Primary Examiner* — Patrick M Buechner
(74) *Attorney, Agent, or Firm* — Thomas Schneck

(57) ABSTRACT

A fluid dispense head is removably joined to a bottle, such as a wine bottle, or similar container, by having a hollow cylinder extend into the bottle and on one end sealed to a neck of the bottle with an annular gasket and on an opposite end joined to the dispense head. A nut on opposite end of the hollow cylinder limits entry of the cylinder into the bottle. When the nut is turned relative to the cylinder, the gasket seal is broken and the dispense head can be removed from the bottle. A set of annular gaskets of different diameters may be provided for bottles of different neck sizes.

9 Claims, 8 Drawing Sheets

*Fig. 1* *(Prior Art)*

LIQUID DISPENSING HEAD FORCIBLY DETACHABLE FROM BOTTLE OR CONTAINER

CROSS-REFERENCE TO RELATED APPLICATION

This application claims priority from U.S. provisional application No. 61/528,549, filed Aug. 29, 2011.

TECHNICAL FIELD

The embodiments relate to a method and device for dispensing liquid and, more specifically, to an improved dispense head for an automated liquid dispensing machine.

BACKGROUND

Liquid dispensing machines, such as wine dispensing machines, are currently sold and are in increasing use and popularity. For example, Wine Station® brand liquid dispensing device sold by Napa Technologies, Inc. of Campbell, Calif. allows the precise dispensing of wine. This wine dispensing system uses gas displacement to displace a precise volume of wine. The system allows displacement of different volumes of wine allowing a pour of a taste, half glass, or full glass amount which may correspond to a 1 oz., 4 oz., or 8 oz. pour of dispensed liquid. The gas used for displacement may be nitrogen or another gas which does not react or degrade wine. This allows the system to dispense wine without degradation of the wine between pours. Such a dispense system also allows better tracking of the wine inventory for a retailer since the devices are configured to connect to a centralized computer system.

One unique and advantageous feature of the Wine Station wine dispensing system is the unique dispense head. With reference to FIG. 1, a profile of a dispense head 10 is shown. This dispense head includes a gas input 16 positioned at the rear of the dispense head when the dispense head is inserted into a wine dispensing machine. Gas input 16 then forms a gas-tight seal with a gas output on the machine. A metered amount of gas then flows through the machine to displace wine.

Opposite the gas input 16 is dispense spout 12. Dispense spout 12 is a hollow tube through which wine flows when wine is dispensed by the dispensing system. A rotatable valve assembly 14 is also controlled by the wine dispensing system when dispense head 10 is attached to a wine bottle and the dispense head inserted into the wine dispense machine such that gas input 16 mates with a gas output on the wine dispensing machine. Rotatable valve assembly may be rotated such that different channels within the rotatable valve assembly 14 align with different passageways within the dispense head. For example, if the gas input is simply aligned with the dispense spout 12. A puff of gas will pass through the dispense spout 12. This allows the dispense spout 12 to be cleared of any fluid which may be retained within the dispense spout. On the lower side of the dispense head 10 under the valve assembly 14 is a cap 18 which sits over the neck of a wine bottle. Within cap 18 is the tapered cylinder 26 which fits into a wine bottle. At the lower end of the tapered cylinder 26 is a tube mount 20. Onto mount 20 a tube 22 is mounted. This tube 22 extends to the bottom of a wine bottle and when gas flows from gas input 16 through holes on tapered cylinder 26 the wine is displaced and will flow into the open bottom end of tube 22 and into a channel in the dispense head 10 and out dispense spout 12.

FIG. 2 shows another view of the dispense head 10 attached to wine bottle neck 50. As seen above, cap 18 covers the top of wine bottle neck 50. Gas input 16 is opposite dispense spout 12. On the body 40 of dispense head 10 is a valve assembly cap 30. Extending through valve assembly cap 30 is a rotating tab 52. When rotating tab 52 is rotated by the wine dispensing system different pathways for gas and liquid travel are aligned. For example, if a channel from gas input 16 is blocked by rotation of rotating cap 52 no gas will flow through the system. This affectively seals the wine bottle as long as any channel leading to dispense spout 12 is also blocked. The sealed wine bottle can then be removed from a wine dispensing system and stored or replaced with an alternative wine bottle. In a second operation the channel leading from gas input 16 is connected through to the channel leading into the tapered cylinder 26. This would cause liquid to flow up tube 22 (shown in FIG. 1) and into a channel in the dispense head 10 that leads to the dispense spout 12. In a third operation created by rotation of rotating cap 52 the gas input 16 is directly connected to dispense spout 12. This allows a puff of air to flow through the dispense spout to clear it of any liquid.

With reference to FIG. 3, an exploded view of the dispense head 10 again shows the body 40 of dispense head 10 having a dispense spout 12 at one end and a gas input 16 at the opposite end. A cap 18 is affixed below body 40 and extends above the open end of the wine bottle when the dispense head 10 is attached to the wine bottle. Seated with the valve mount 38 on body 40 is the rotatable valve assembly 14. This includes the valve assembly cap 30 positioned over rotating valve 34. The channels discussed above allowing connections of the gas input and wine output are on the underside of rotating valve 34. This can be seen in U.S. Pat. No. 7,712,631 which is hereby incorporated by reference for all purposes herein. Rotating valve 34 has a tab 34A which may be rotated by the wine dispensing system. An inner O-ring seal 32 seals rotating valve 34 to valve assembly cap 30 to prevent leaks.

On the sides of body 40 are mounted bands 36A, 36B. These bands have pins 37A, 37B which extend into the dispense spout 12. Bands 36A, 36B make an electrical connection with the wine dispense system. This allows electronic determination of whether the dispense head is properly inserted into the dispense machine. In addition the impedance may be measured as wine is dispensed. For example, the measuring of bubbles (even microbubbles) will be detectable and allow an alert that the wine level within a bottle is low.

The underside of the dispense head 10 includes a bottle mount assembly 80. This includes a cap 18 which extends around the neck of the wine bottle. Within cap 18 are tapered cylinder 26 which fits into a wine bottle as shown in FIG. 2. A retainer ring 82 holds intake tube mount 84. This provides the channel through which the wine will flow.

With reference to FIG. 4 the underside of dispense head 10 again shows a dispense spout 12 on one side of the device and gas input 16 on the opposing side. Cap 18 is mounted on body 40 and extends about the back of the wine bottle. A tube mount 20 on tapered cylinder 26 allows attachment of a tube which extends to the bottom of a wine bottle. Gas ports 24 on surface 28 on tapered cylinder 26 allow the flow of gas into a wine bottle to establish a pressurized head. Tapered cylinder 26 is extended into the wine bottle. The taper of tapered cylinder 26 allows the dispense head to be fitted into a variety of different wine bottles having different diameter bottle neck openings.

In use the present device has experienced some problems. For example, leakage is a possible problem in this pressurized device. Although the device is designed for use with a variety of different sized wine bottle necks, the variety of different wine bottle necks has been challenging to accommodate without gas leakage. Some attempts have been made to use washer-like spacers within wine bottle necks to forma better seal. However, given that these are not part of the dispense head this has proved non-ideal. It is an objective to provide a dispense head with more robust leak prevention.

DETAILED DESCRIPTION

The present embodiments provide a number of improved features to a dispense head. These include removable and exchangeable gaskets. This feature allows for the ability to exchange or replace gaskets by simply unscrewing a threaded nut at the bottom stem of the dispense head. There is no standard for the diameter of a one bottle neck opening. For this reason a variety of one bottle gasket sizes are needed to adapt a dispense head to the variety of different wine bottle neck openings. The stem that is inserted into the wine bottle of a dispense head requires multiple channels to enable gas, pressurization, gas purging and liquid pouring. The present gaskets described herein allow a plurality of different gaskets to be secured on this stem such that it is usable for a variety of different bottle neck openings. In addition, the cap of the rotatable valve assembly includes molding that protects wine leaks from occurring through the cap when the wine bottle is pressurized. In addition the disclosed embodiments show a spout design which provides for quick removal and cleaning.

Figure 5A:
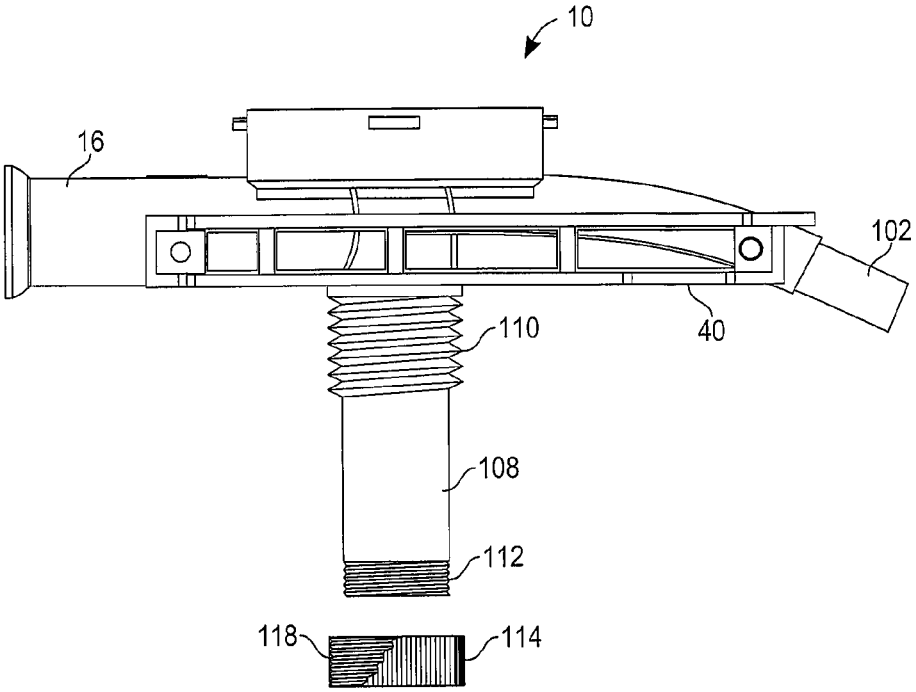
FIG. 5A is a side view of an improved dispense head.
Figure 5B:
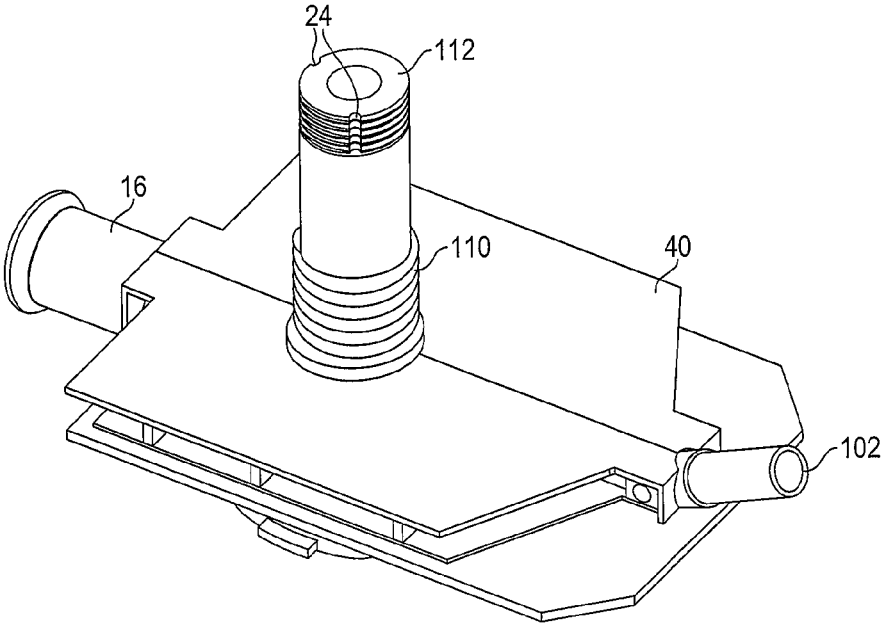
FIG. 5B is a bottom perspective view the dispense head of FIG. 5A.

With reference to FIGS. 5A and 5B, as in the prior design the dispense head 10 includes a gas intake 16 mounted on or molded onto body 40. Opposing side body 40 includes a spout mount 102.

Figure 6:
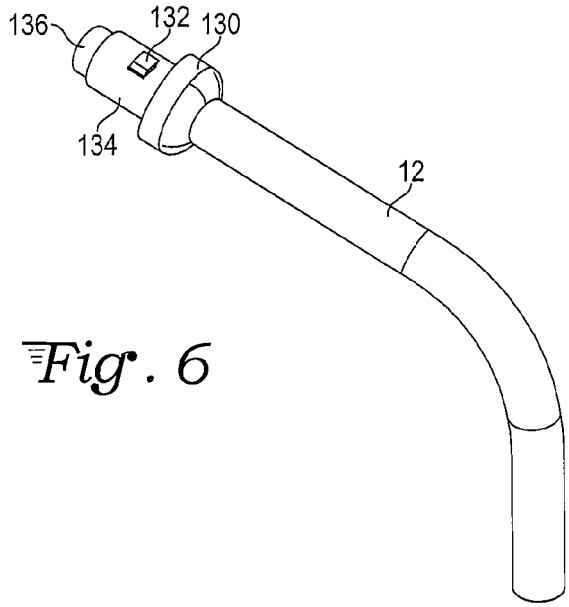
FIG. 6 is a side perspective view of a detachable pour spout.

With reference to FIG. 6, onto spout mount 102 in FIGS. 5A, 5B may be mounted a pour spout 12 as shown in FIG. 6. This spout includes a mount pipe 136, a bushing 134, and a collar 130. The spout mount 102 allows the bushing 134 to fit over and mount pipe 136 to fit within spout mount 102. A resilient button 132 may lock onto spout mount 102 of FIG. 5A, 5B to hold pour spout 12 in place. In this manner the pour spout may be easily removed for cleaning or replaced in case of damage. This may be done even while the wine bottle has a dispense head mounted on it and the interior space of the bottle pressurized.

Returning to FIGS. 5A, 5B, the body 40 also has a cylinder 108 mounted on it. At an upper end of bottle extending cylinder 108 are nut threads 110. At a lower end bottle extending cylinder 108 are external gasket threads 112. This allows attachment of an external gasket 114 having internal threads 118. A variety of different gasket sizes may be provided allowing the device to be used on a variety of wine bottle neck openings.

Figure 1:
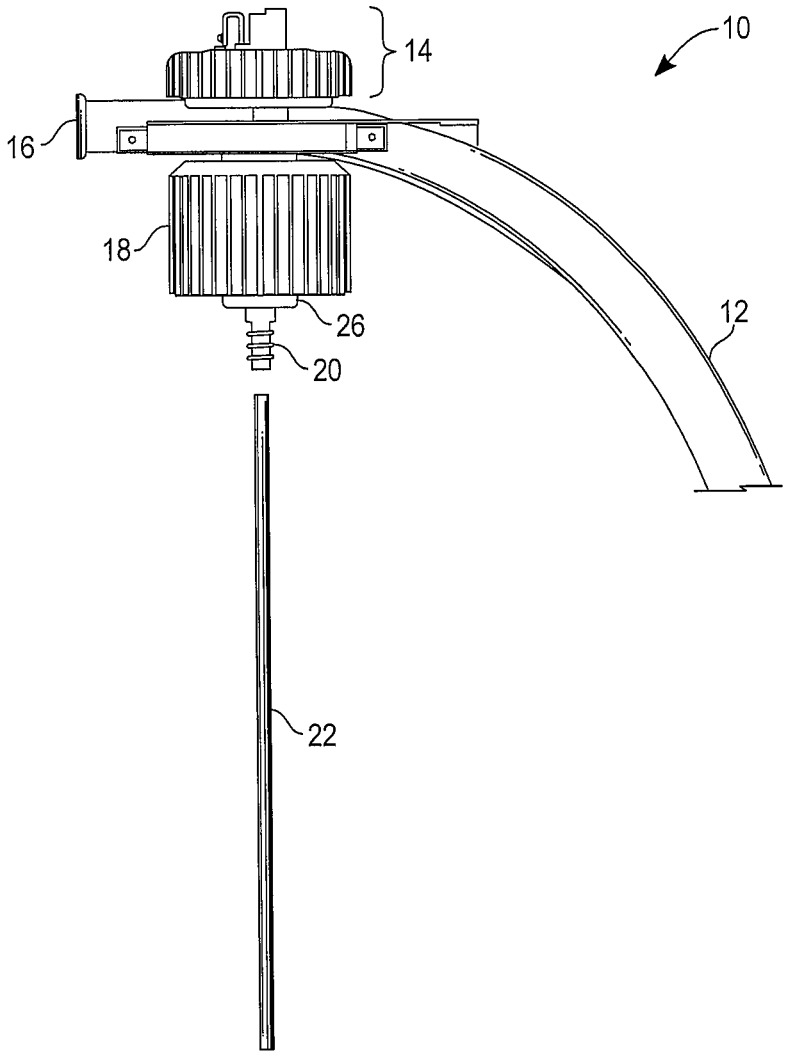
FIG. 1 is a side view of a prior art dispense head.
Figure 2:
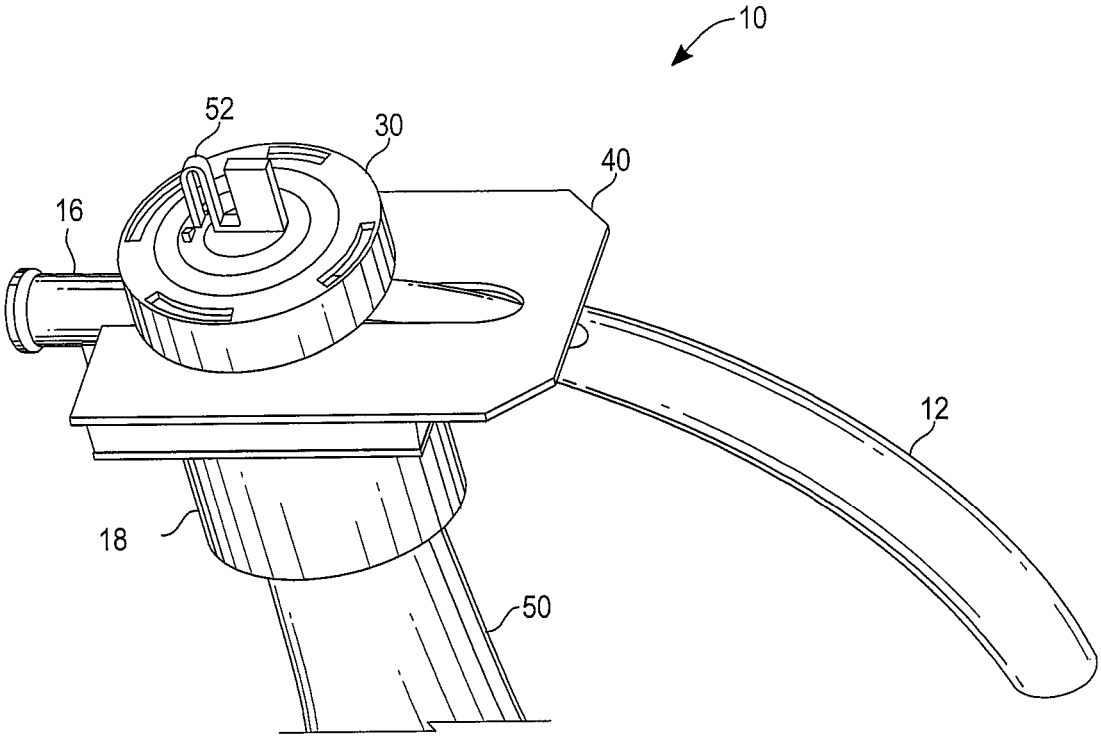
Fig. 2 (Prior Art)
FIG. 2 is a top perspective view of the dispense head of FIG. 1 as inserted into a wine bottle.
Figure 3:
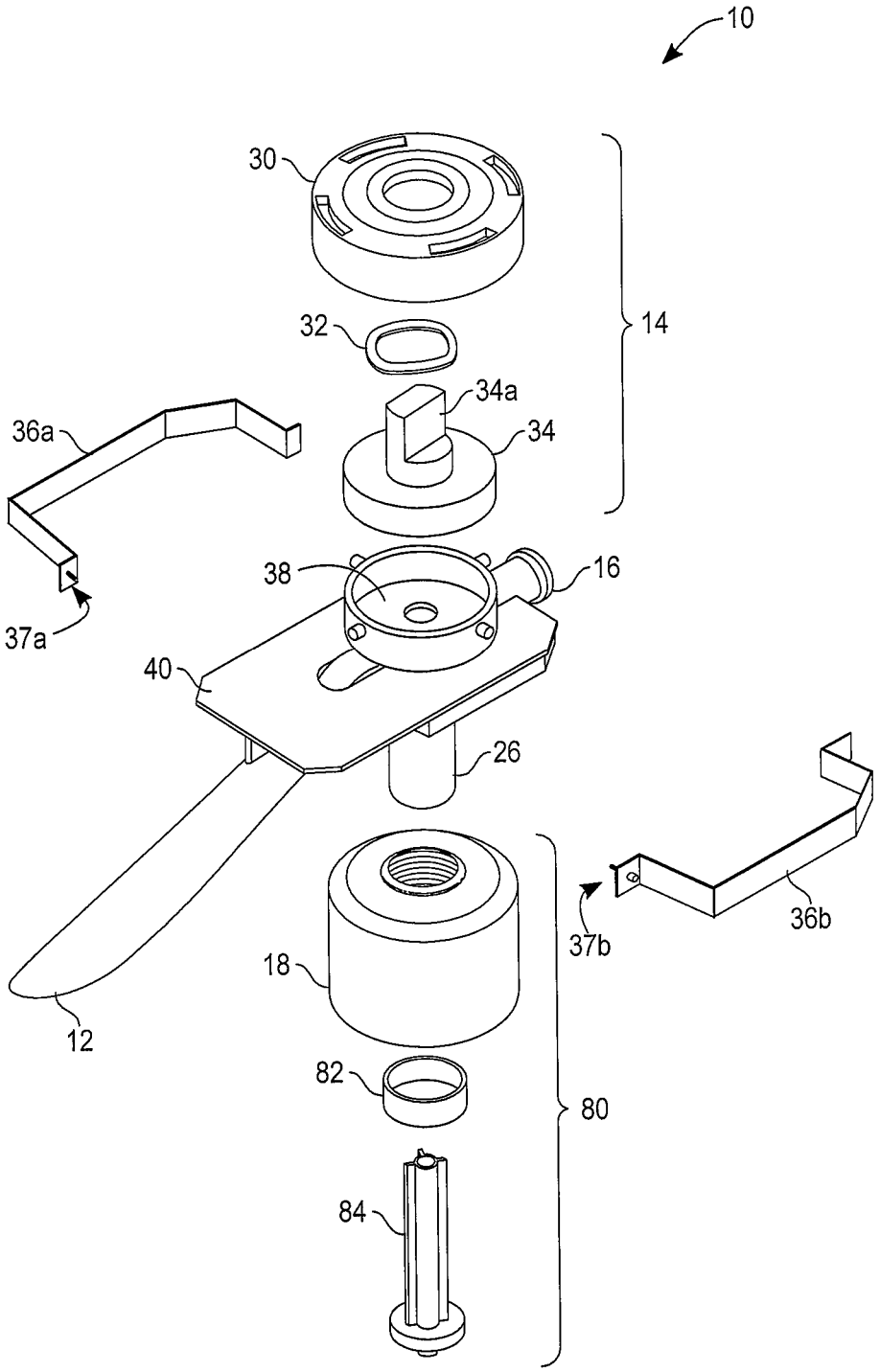
Fig. 3 (Prior Art)
FIG. 3 is an exploded view of the dispense head of FIG. 1.
Figure 4:
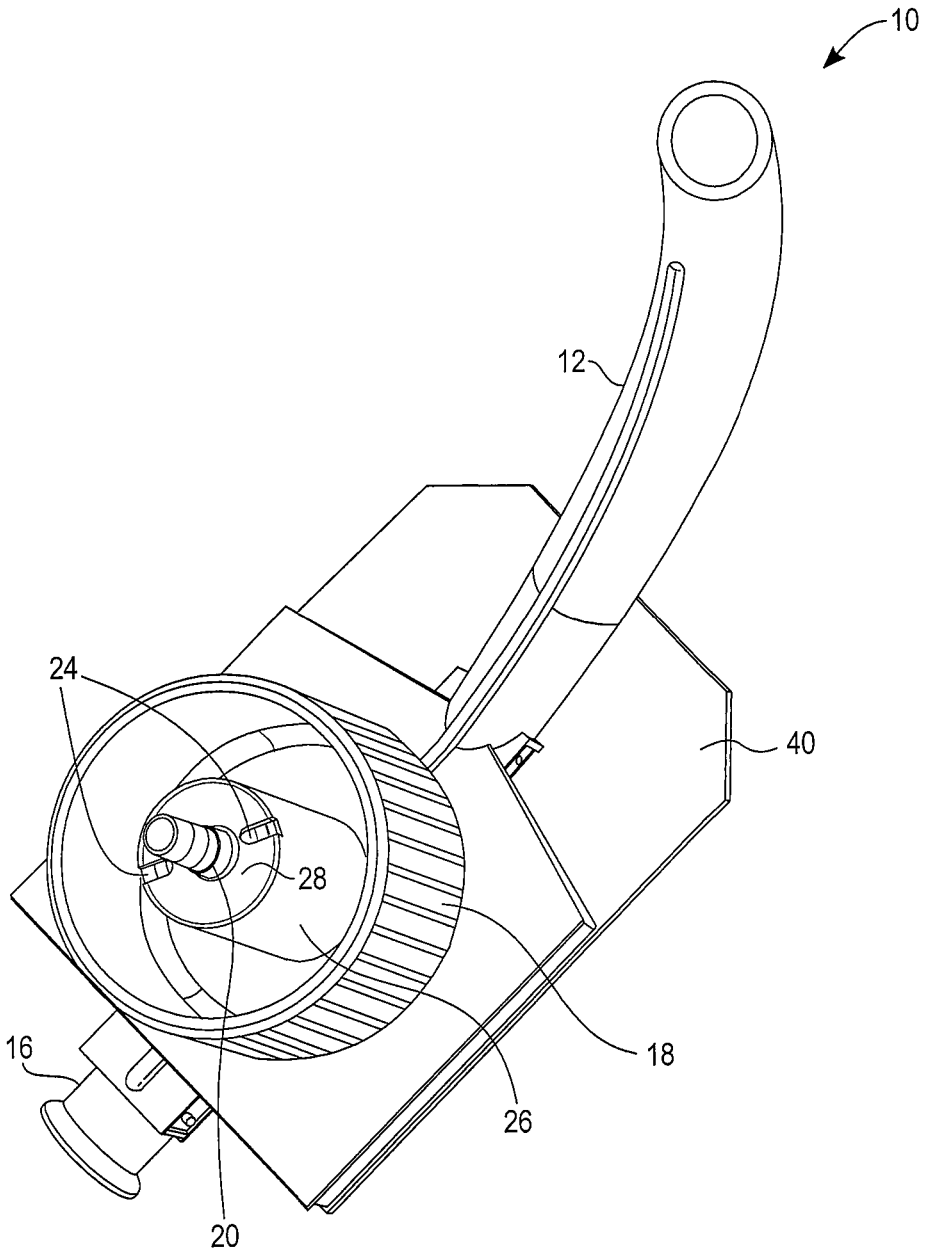
Fig. 4 (Prior Art)
FIG. 4 is an underside view of the dispense head of FIG. 1.
Figure 7A:
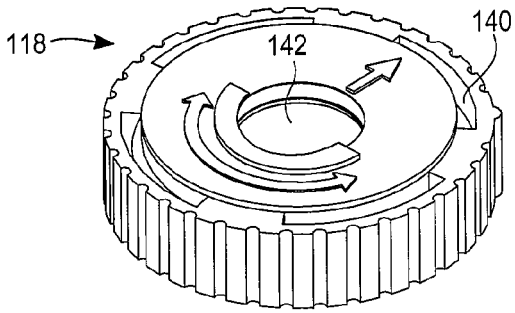
FIG. 7A is a top view of rotatable cap.
Figure 7B:
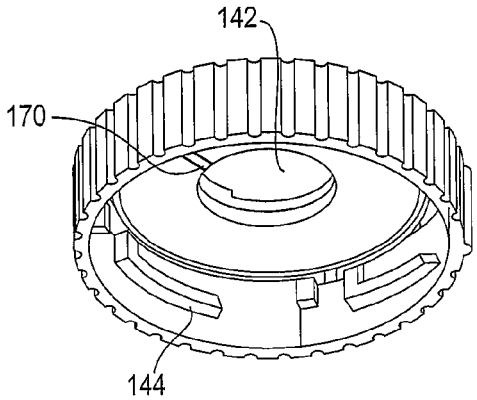
FIG. 7B is a bottom view of the rotatable valve cap of FIG. 7A.
Figure 7C:
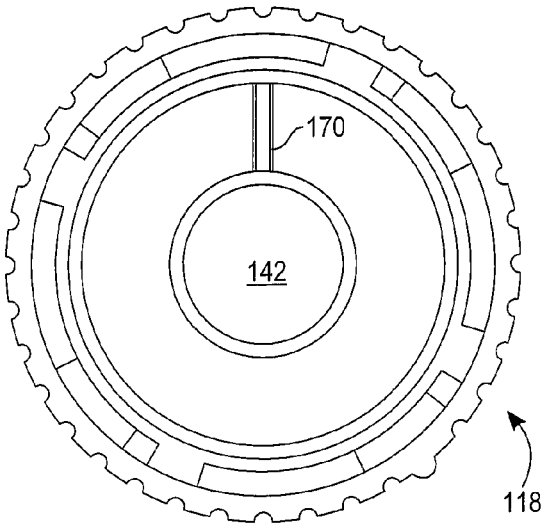
FIG. 7C is a top view of the cap of FIG. 7A.
Figure 7D:
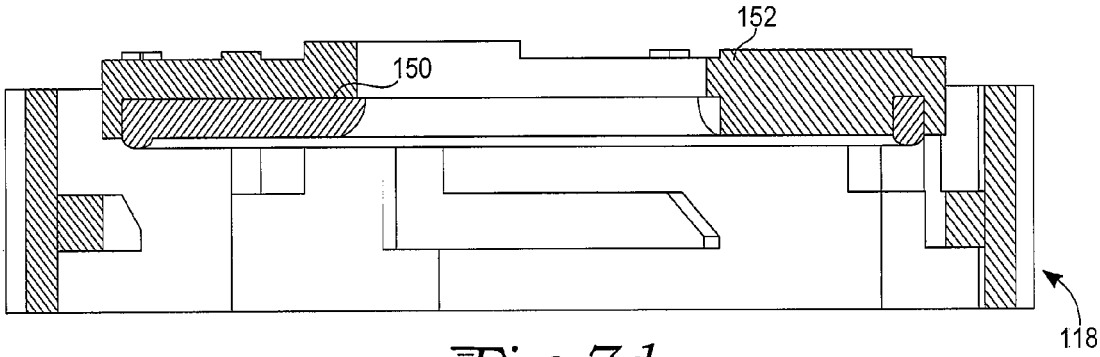
FIG. 7D is a cross sectional view of the cap shown in FIG. 7A.
Figure 7E:
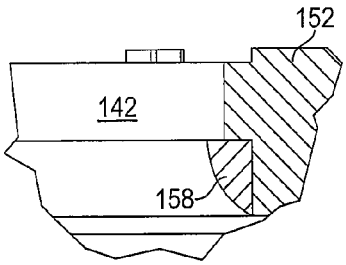
FIG. 7E is a detail of an internal annular resilient member.
Figure 7F:
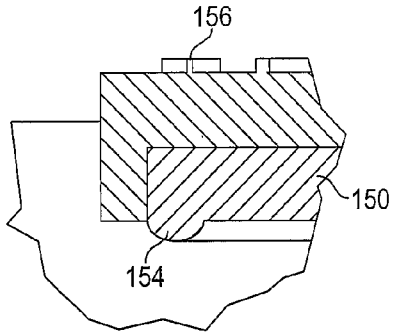
FIG. 7F is a detail of another annular resilient member.
Figure 7G:
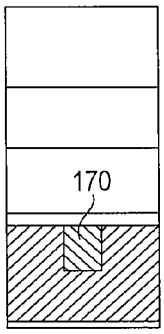
FIG. 7*g* is a cross section of the cap's overmolding.

As shown in FIG. 5A, the rotatable valve assembly is shown without some parts, which are shown in FIGS. 1-4. The valve assembly portions including the valve mount and rotating valve as shown in FIG. 3 are still utilized. The cap has been modified to prevent leaks. With respect to FIGS. 7A, 7B the cap 118 is shown having a plurality of arched holes 140 and a center hole 142. A rotating valve tab extends through center hole 142. In FIG. 7B a track 144 is shown. Track 144 mates with other elements of the rotating valve simply to ensure a limited range of motion of the rotating valve. This ensures that only certain internal channels are alignable. With reference to FIGS. 7C, 7D, 7E, 7F and 7G the underside of cap 118 shown in FIG. 7C and including cap center hole 142 includes a resilient over molding 170 extending from a edge of the radial area at center hole opening 142 across the substantially flat surface of the underside of the cap to a annular curved internal edge within cap 118. As shown in cross sectional view 7D the underside of cap 118 includes a resilient annular member 150 and a cap underside structure 152. Detail at FIG. 7E shows underside structure 152 having a resilient annular member 158 extending from the side of structure 152 into opening 142. Resilient annular structure 158 has a radius such that a rotatable valve structure extended through cap 118 will be compressed against resilient annular structure 158 to form a seal. On the underside of cap 142 a second resilient structure extending to the arch shaped holes 140 shown in FIGS. 7A, 7B are sealed by resilient annular member 150 having a resilient annular bump 154. Bump 154 presses against the disk inserted within the rotatable valve assembly. This prevents wine from leaking through openings 142.

Figure 8:
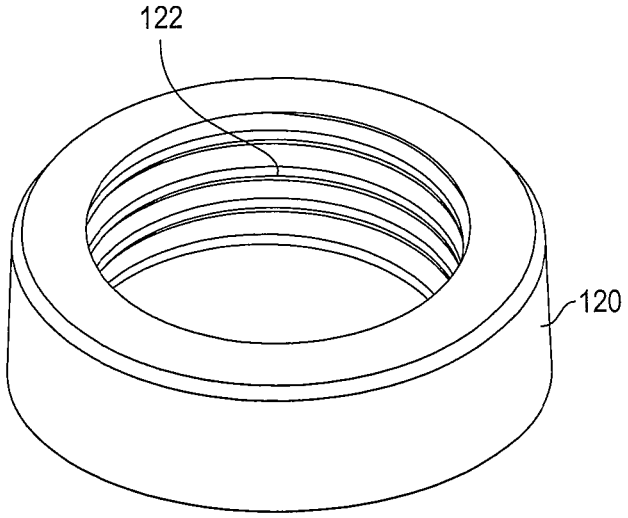
FIG. 8 is a top perspective view of a nut.

With reference to FIG. 8, a nut 120 having internal threads 122 may be attached to the threads 110 on bottle extending cylinder 108. This nut serves as the limit for insertion of the dispense head into a wine bottle. The dispense head may then be removed by rotating the nut which would then force the dispense head with the mounted gasket above the wine bottle neck.

The removal and exchangeable gaskets, the modified cap ceiling design and the removable dispense head designs may be used individually or in any combination on dispense heads. This provides advantages, such as greater resistance to leaking or greater ability to clean parts of the device.

What is claimed is:

1. An apparatus for removably joining a liquid containing bottle having a neck to a dispense head with spout of the type having a gas valve controlling gas pressure pumping of fluid from the liquid containing bottle comprising:

an axially hollow cylinder with a first cylinder portion adapted to fit inside the neck of a bottle and a second cylinder portion outside the neck and supporting the dispense head, the cylinder having threads at opposite ends thereof along the first cylinder portion and second cylinder portion thereof;

a turnable nut engaging threads on the second cylinder portion of the cylinder and contacting the neck at an end thereof, limiting entry of the hollow cylinder into the bottle;

a screw-on gasket having an inner surface engaging threads on said first cylinder portion and having an outer surface engaging the inside of the neck in a manner sealing an outside surface of the cylinder against the neck said gasket allowing exposure of an end of said hollow cylinder;

whereby turning the nut when the hollow cylinder and gasket are in place forces the cylinder to move axially and breaks the gasket seal with the neck.

2. The apparatus of claim 1 wherein the gasket is an annular gasket.

3. The apparatus of claim 1 wherein the bottle neck is part of a wine bottle.

4. A liquid dispense head apparatus removable from a liquid container comprising:

a dispense head;

a gas input port on said dispense head;

a pour spout opposite said gas input port on said dispense head;

a rotating valve assembly including;

a cap having a central hole;

a rotating valve member fitting inside said cap having a tab extending through said central hole;

a first annular resilient member on said cap extending centrally into said hole such that said rotating valve member forms a first liquid tight seal with said first annular resilient member when said rotating valve member has said tab extend through said hole;

a second annular resilient member positioned on an underside of said cap radially outward from said central hole such that said rotating valve member forms a second liquid tight seal with said second annular resilient member;

a bottle neck cylinder extending from said dispense head connectable by said rotating valve member to said gas input port such that when gas is provided to said gas input port and said rotating valve member is positioned to allow gas communication, gas will flow from an opening in said bottle neck cylinder;

a tube extending from an end of said bottle neck cylinder;

first external threads on a terminal end of said bottle neck cylinder;

a gasket secured to said first external threads lodging the gasket inside of the liquid container said gasket allowing exposure of an end of said bottle neck cylinder; and a nut associated with second threads on the bottle neck cylinder distal to the terminal end;

whereby turning the nut on the second threads dislodges the gasket, allowing removal of the dispense head.

5. The apparatus of claim 4 wherein the liquid container is a wine bottle and the bottle neck cylinder fits into a neck of the wine bottle.

6. The apparatus of claim 5 wherein the gasket is an annular gasket that seals the bottle neck cylinder to the bottle neck.

7. The apparatus of claim 4 wherein the gasket is an annular gasket.

8. An apparatus for removably joining a liquid containing bottle having an neck to a dispense head with spout having a gas valve controlling gas pressure pumping of fluid from the bottle wherein the improvement comprises;

a bottle neck hollow cylinder extending from a dispense head body into said bottle at a terminal end thereof;

first external threads on the terminal end of the cylinder;

an annular gasket secured to said first external threads, said annular gasket having an open end exposing a terminal face of said bottle neck hollow cylinder; and a nut associated with second threads on the bottle neck cylinder distal to the terminal end, limiting entry of the bottle neck hollow cylinder into the bottle;

whereby turning the nut on the second threads dislodges the gasket, allowing removal of the dispense head.

9. The apparatus of claim 8 wherein the liquid containing bottle is a wine bottle.

* * * * *